United States Patent [19]

Passons et al.

[11] 4,419,944

[45] Dec. 13, 1983

[54] MULTIPLE STROKE LOOPER MECHANISM FOR STITCHING MACHINE

[76] Inventors: William E. Passons, 3782 Kings Road, Chattanooga, Tenn. 37416; Joseph L. Card; Roy T. Card, both of P.O. Box 24, Hixson, Tenn. 37343

[21] Appl. No.: 319,213

[22] Filed: Nov. 9, 1981

[51] Int. Cl.[3] ..... D05C 15/00

[52] U.S. Cl. ..... 112/79 R

[58] Field of Search ..... 112/79 R, 79 FF, 79 A, 112/199

[56] References Cited

U.S. PATENT DOCUMENTS

| | | | |
|---|---|---|---|
| 287,592 | 10/1883 | Thimonnier et al. | 112/199 |
| 1,796,236 | 3/1931 | Boettcher | 112/119 X |
| 3,401,657 | 9/1968 | Watkins | 112/79 R |
| 3,421,929 | 1/1969 | Watkins | 112/79 R |
| 3,735,715 | 5/1973 | Passons et al. | 112/79 R |
| 3,919,952 | 11/1973 | Lund | 112/79 R |
| 3,978,800 | 9/1976 | Card et al. | 112/79 R |
| 4,029,030 | 6/1977 | Smith | 112/79 A |
| 4,103,629 | 8/1978 | Card | 112/79 R |
| 4,155,319 | 5/1979 | Short | 112/79 R |
| 4,285,286 | 8/1981 | Hash | 112/79 R |

*Primary Examiner*—Ronald Feldbaum

*Attorney, Agent, or Firm*—Harrington A. Lackey

[57] ABSTRACT

A method and apparatus for forming a longitudinal row of stitching in a base fabric with a reciprocal needle and cooperating looper, in which the looper is driven through two or more strokes for each stroke of the needle in a stitch cycle. In the preferred form of the invention, the looper points in the opposite direction from the longitudinal direction of movement of the base fabric, for the formation of either loop pile or cut pile stitching. When loop pile is formed, the stitching results in a chain stitch.

13 Claims, 23 Drawing Figures

Fig. 1
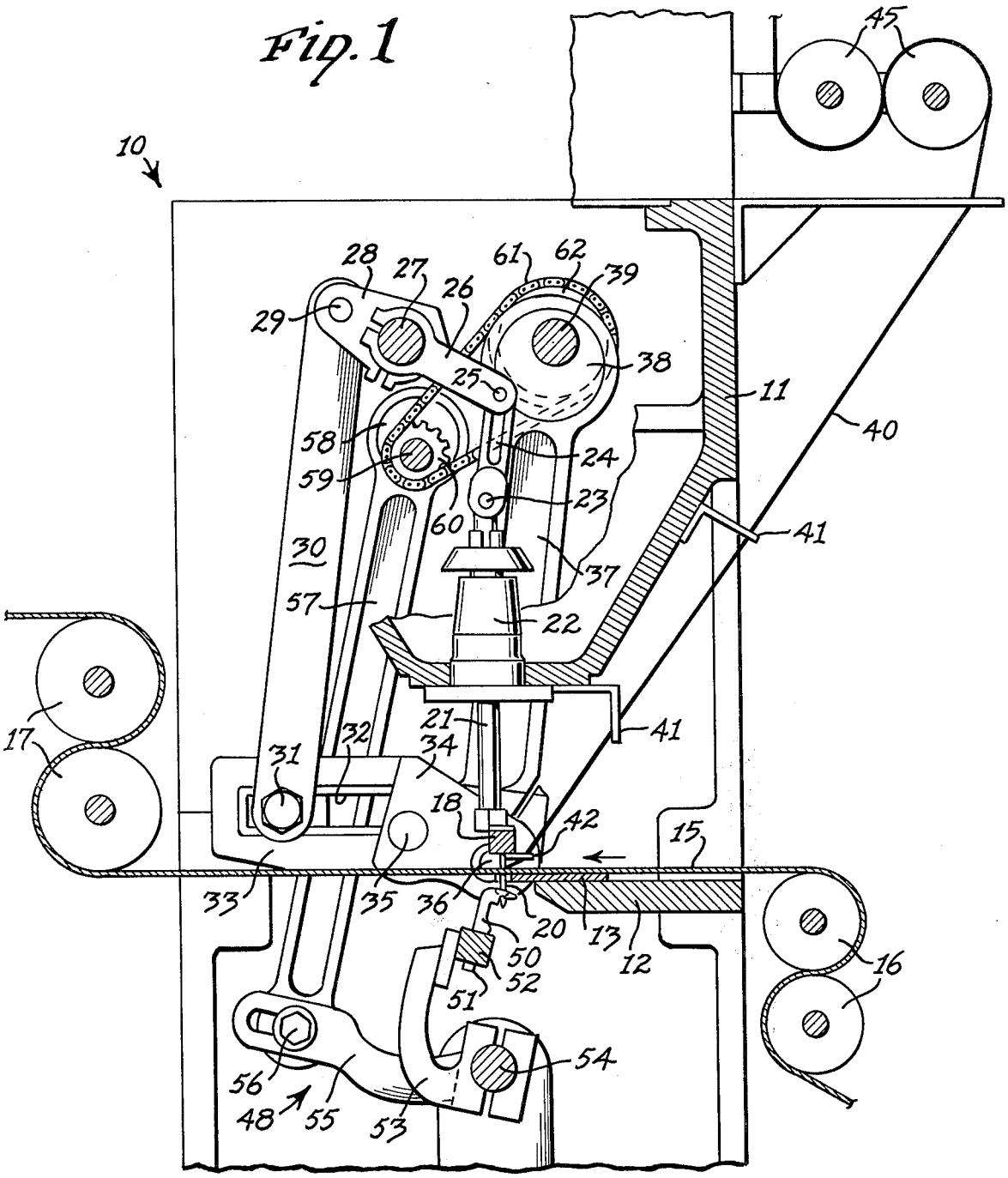
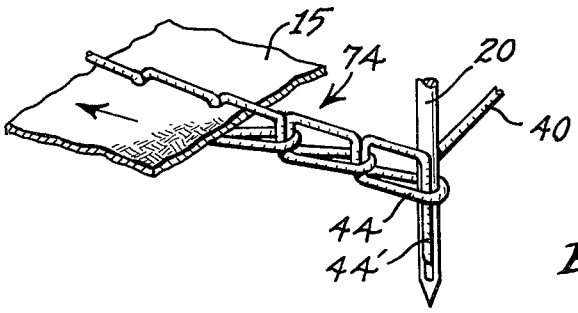
Fig. 2

MULTIPLE STROKE LOOPER MECHANISM FOR STITCHING MACHINE

BACKGROUND OF THE INVENTION

This invention relates to a stitching machine, and more particularly to a stitching machine having a multiple stroke looper mechanism.

Heretofore in the art of tufting, loop pile tufts are formed by one or more needles reciprocably driven to penetrate a moving base fabric to form a yarn loop on the opposite side of the base fabric, which is seized by a cooperating looper pointing in the same direction as the movement of the base fabric and having the same number of cyclical reciprocable strokes as the needle. In order to form cut pile tufts, a cut pile hook is substituted for each loop pile hook, but pointed in the opposite direction from the longitudinal direction of movement of the base fabric, to cooperate with a knife to cut the respective loops formed by the needle.

Chain stitching has been formed by a tufting machine, such as that disclosed in the Watkins U.S. Pat. No. 3,421,929, issued Jan. 14, 1969. However, in the Watkins patent, two loopers of different designs are used in cooperation with a laterally shifting yarn-supporting finger to operate on a single yarn to form a chain stitch. One of the loopers is a single-blade hook for seizing the yarn loop from the needle, while the other looper includes spaced prongs for spreading the seized loop for subsequent penetration by the needle.

In the Short U.S. Pat. No. 3,780,678, issued Dec. 25, 1973, a tufting machine is disclosed for forming loop pile in order to avoid the accidental formation of chain stitching, which Short considered undesirable. The Short patent also discusses the accidental and undesirable formation of chain stitching by other prior art tufting methods and apparatus.

The Watkins U.S. Pat. No. 3,401,657, issued Sept. 17, 1968, discloses a tufting machine for making chain stitches in which a pair of loopers alternately cooperate with a needle and each looper reciprocates at one-half the speed of the needle.

The Hash U.S. Pat. No. 4,285,286, issued Aug. 25, 1981, discloses a primary looper and a transfer looper for each needle, opposing each other and mounted on the same looper bar. The primary looper seizes the loop carried by the needle, and sequentially transfers the loop to the transfer looper which opens the loop for penetration by the needle on the next stroke, to form a chain-stitch. The loopers reciprocate at the same rate as the needle.

SUMMARY OF THE INVENTION

It is therefore an object of this invention to provide a simplified method and apparatus for the formation of chain stitching, and also to provide an improved method and apparatus for forming cut pile tufting.

In order to form the unique stitching in accordance with this invention, a conventional tufting needle is supported on one side of a base fabric moving in one longitudinal direction, and the needle is reciprocably driven to carry yarn cyclically through the base fabric on each stroke of the needle. A looper or hook is mounted on the opposite side of the base fabric pointing in the direction opposite from the longitudinal direction of movement of the base fabrid and reciprocably mounted to cooperate with the needle to seize the yarn to form loops. However, the looper is driven to execute two or more strokes for each stroke of the needle for each stitch cycle.

Where the ratio of the looper stroke to the needle stroke is two to one, the looper crosses the needle and seizes a yarn loop carried by the needle upon the first looper stroke of the stitch cycle, and then on the second looper stroke of the same stitch cycle, the looper crosses the needle path, before the needle descends, to place the stretched, open, seized, yarn loop in the path of the descending needle. The needle then penetrates the open loop, holds the loop, and then removes the seized loop from the looper as the looper moves away from the needle path, to thereby form a chain stitch.

Since the looper is pointing in the opposite direction from the movement of the base fabric (the opposite mode from a typical loop pile tufting operation), the seizure of the loop is assisted by the movement of the yarn loop upon the bill of the hook and away from the pointed end of the bill. Moreover, the movement of the fabric also assists in stretching the loop to an open position for penetration by the needle upon the second looper stroke of the cycle.

The multiple stroke looper may also cooperate with a knife in a conventional manner for producing a cut pile. Although cut pile tufts are formed only on alternate strokes of the looper, nevertheless the amplitude of the looper strokes, or distance through which the looper reciprocates, may be substantially less, thereby requiring smaller pressure angles between the knife and the looper to reduce the wear on the looper and the knife, and prolong their lives.

The looper made in accordance with this invention may include a pair of hook blades spaced side by side, with the points of the bills biased together. Such a double-bladed hook permits seizure of the yarn loop from the needle on the first looper stroke, and positively spreads the loop on the second looper stroke to facilitate penetration of the loop by the needle on its downstroke.

BRIEF DESCRIPTION OF THE DRAWINGS

FIG. 1 is a fragmentary sectional elevation of a stitching machine made in accordance with this invention, illustrating a needle penetrating the moving base fabric and the looper cooperating with the needle;

FIG. 2 is a fragmentary, top perspective view illustrating the formation of the chain stitch, with portions of the base fabric removed, and the fragmentary needle illustrated in its lower position;

DESCRIPTION OF THE PREFERRED EMBODIMENTS

Figures 3, 4, 5, 6, 7, 8, 9, 10, 11:
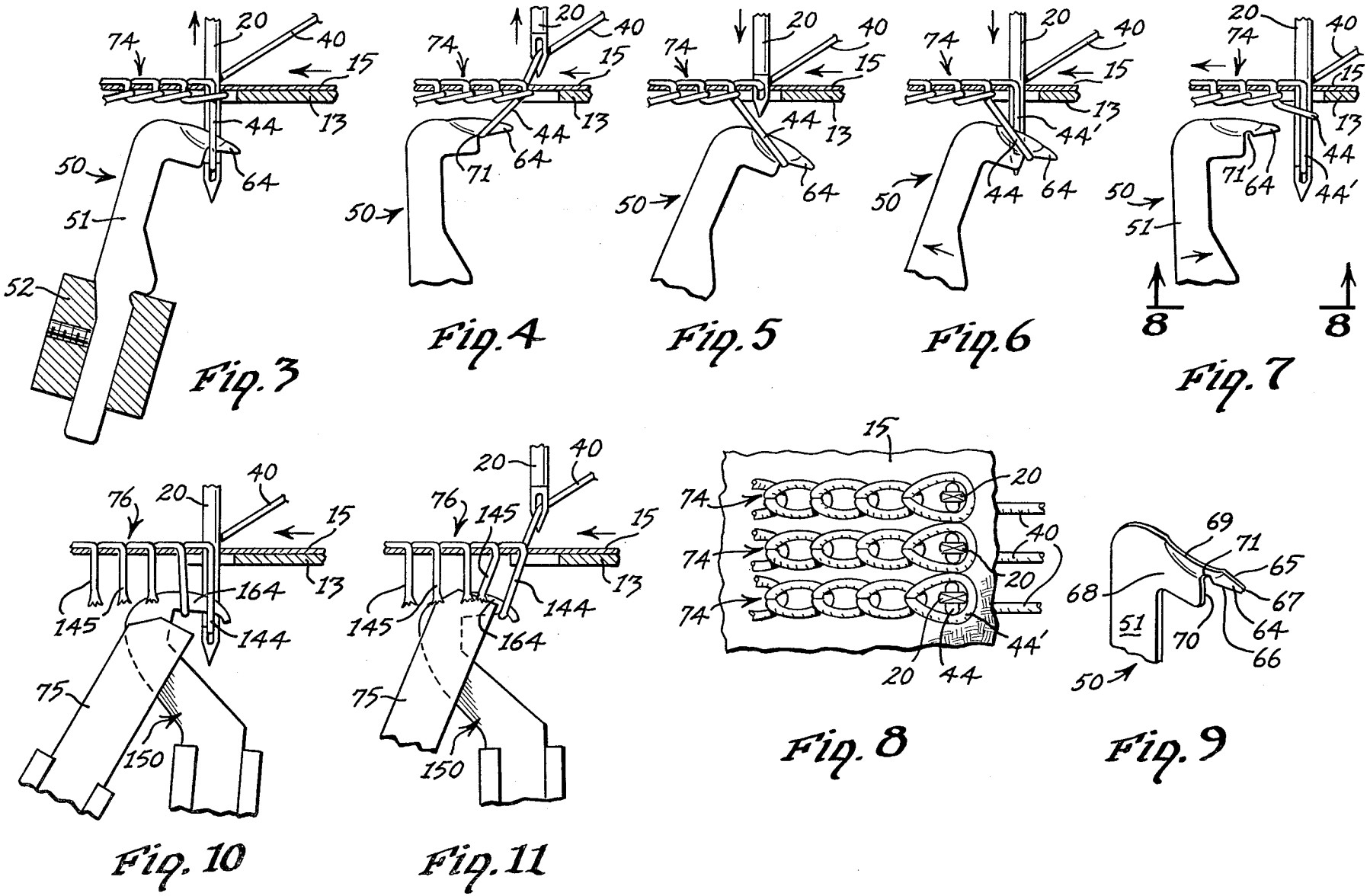
FIG. 3 is an enlarged fragmentary sectional elevation, schematically illustrating the looper at the forward end of its first stroke in a stitch cycle engaging the yarn loop carried by the needle.
FIG. 4 is a view similar to FIG. 3, illustrating a subsequent step of loop seizure with the looper retracted near the rear end of its first stroke and the needle in an upper position.
FIG. 5 is a view similar to FIG. 4, illustrating a subsequent step in which the looper is near the front end of its second stroke of the stitch cycle, stretching the seized loop for penetration by the descending needle.
FIG. 6 is a view similar to FIG. 5, in which the needle has penetrated the seized loop and the looper is withdrawing from the loop.
FIG. 7 is a view similar to FIG. 6, illustrating the looper near the rear end of its second stroke in the stitch cycle, completely retracted from the loop which is now seized by the needle to form the chain stitch.
FIG. 8 is an enlarged, fragmentary, bottom plan view of the chain stitches formed in the base fabric, taken along the line 8—8 of FIG. 7, with the looper removed.
FIG. 9 is a fragmentary, top perspective view of one form of looper used for the formation of the chain stitches.
FIG. 10 is a fragmentary, sectional elevational view, similar to FIG. 3, of a modified form of looper mechanism in which cut pile is formed, disclosing the looper near the front end of its first stroke in the stitch cycle.
FIG. 11 is a view similar to FIG. 10, illustrating the subsequent step of cutting the yarn loop, with the looper near the rear end of its first stroke in the first cycle.

Referring now to the drawings in more detail, FIG. 1 discloses a stitching machine 10, specifically in the form of a tufting machine, made in accordance with this invention, including a frame or housing 11 having a bed-plate 12 upon which is supported a needle plate 13. The needle plate 13 is adapted to support, in a substantially horizontal plane, a base fabric 15 adapted to be moved by a conventional means, such as the fabric feed rolls 16 and 17, in the direction of the arrow from front-to-rear through the machine 10.

Extending transversely of the machine 10 above the needle plate 13 is an elongated needle bar 18. Mounted to depend from the needle bar 18 are one or more uniformly spaced needles 20 (only one of which is shown in the drawings), preferably arranged in a transverse vertical plane, of uniform length and mounted to depend to a uniform depth. The needle bar 18 is supported by a plurality of transversely spaced, push rods 21, only one of which is shown in the drawings. Each push rod 21 is adapted to vertically reciprocate within the sleeve or bearing 22 in the housing 11. The upper end of the push rod 21 is pivotally connected by a pin 23 to the lower end of link arm 24, the upper end of which is pivotally connected by pin 25 to drive lever 26 fixed to rock shaft 27. The rock shaft 27 supports a plurality of drive levers 26, there being one drive lever 26 for each push rod 21.

One end of the rock shaft 27 is fixed to a rock lever 28 pivotally connected by pin 29 to the upper end of a long link bar 30. The lower end of link bar 30 terminates in a pin 31 adjustably journaled in an elongated slot 32 in the arm 33 of a bell crank 34 mounted upon pivot shaft 35. The opposite arm of the bell crank 34 is pivotally connected by pin 36 to the lower end of an eccentric arm 37. The upper end of the eccentric arm 37 is journaled about the rotary eccentric or cam 38 fixed to the needle shaft 39 in a manner well known in the art. Thus, as the machine 10 is operating by virtue of the continuous rotation of the needle shaft 39 by motive means, not shown, the rock shaft 27 is continuously reciprocated to move the drive levers 26 to reciprocably drive the needles 20 between the upper positions above the plane of the base fabric 15 and lower positions penetrating the base fabric 15.

Yarn 40 is fed through fixed yarn guides 41 and needle bar yarn guide 42 to each of the needles 20 so that a yarn 40 may be carried by each corresponding needle 20 as it penetrates the base fabric 15 to its lowermost position to form a yarn loop 44 (FIG. 3). The yarn 40 may be positively fed to the needles 20 by the yarn feed rolls 45, which may be driven or programmed by means not shown.

The looper mechanism 48 made in accordance with this invention includes a looper, looper hook, or hook 50 adapted to cooperate with each needle 20. The shank 51 of each looper 50 is mounted in a conventional manner in a hook bar 52 mounted on rocker arm 53, which in turn is clamped to the hook shaft 54. The hook shaft 54 is fixed to and driven by a hook drive lever 55, the free end of which is slotted for adjustable pivotal connection by pin 56 to the lower end of connecting rod 57. The upper end of the connecting rod 57 is journaled about the rotary eccentric or cam 58, which in turn is fixed to the hook drive shaft 59, in the form of a rotary jack shaft, journaled for rotary movement in the frame 11.

Fixed to the hook drive shaft 59 is a driven sprocket 60 connected by an endless chain 61 to a drive sprocket 62 fixed to the needle shaft 39 (FIG. 1).

It is an important feature of this invention that the means for driving the hooks 50 must drive the hooks 50 at a multiple number of strokes for each stroke of the needle 20. Accordingly, in the specific embodiment of the needle and hook drive mechanism disclosed in FIG. 1, the drive sprocket 62 has a diameter which is a multiple of the diameter of the driven sprocket 60. In the embodiment disclosed in FIG. 1, the sprocket 62 has twice the diameter, or twice the number of teeth, of the driven sprocket 60, so that the hooks 50 are reciprocated twice as many times as the needle 20 is reciprocated.

The angular positions of the respective eccentric cams 38 and 58 on their corresponding needle shaft 39 and hook drive shaft 59, are so oriented that the needle and hook drive mechanisms are synchronized so that the needle 20 is in a lower position penetrating the base fabric 15 while the looper 50 is in a forward position, crossing the needle 20, as illustrated in FIGS. 1 and 3, for engaging the yarn loop 44.

In one form of the looper 50, a bill 64, having an upper edge 65 and a lower edge 66 generally converging forward to a point 67, projects from a throat portion 68. The throat portion 68 forms an integral extension of the shank 51. The top edge portion of the looper 50 may be laterally curved or indented to form a dished-out portion 69, to facilitate guiding the needle 20 on its downstroke past the looper 50.

Also, preferably formed in the intersection of the lower edge 66 and the front edge 70 of the throat portion 68 of the looper 50, is a groove 71 adapted to receive, and assist in holding, the yarn loop 44 after the yarn loop 44 has been seized, as illustrated in FIG. 4.

In the operation of the invention to form chain-stitching, when the needle 20 rises, as illustrated in FIG. 3, the yarn loop 44 will be seized by the looper bill 64 in the forward position of its first stroke of the stitch cycle. The rearward movement of the base fabric 15 carries the yarn loop 44 rearward upon the bill 64. To facilitate seizure of the yarn loop 44 by the bill 64, the loop 44 is usually caught in the yarn groove 71 to prevent it from slipping off the bill 64 as the looper 50 travels to its rearmost position in its first stroke of the stitch cycle, as illustrated in FIG. 4.

While the needle 20 is still above the base fabric 15, the looper 50 again moves forward in its second stroke of the stitch cycle to carry the yarn loop 44 forward across the needle path. In this forward position of the looper 50 (FIG. 5), the loop 44 is stretched so that the opening of the loop is in alignment with the needle 20 to receive the needle 20 upon its next downstroke.

After the needle 20, carrying the yarn 40, penetrates the opening in the yarn loop 44, as illustrated in FIG. 6, the looper 50 again retracts toward its rearward position (FIG. 7) to remove the bill 64 from the yarn loop 44, now seized upon the needle 20. The downstroke of the needle 20 pulls the yarn 40 down through the base fabric 15 to tighten the release yarn loop 44 about the needle 20 and about the yarn carried by the needle in forming the next yarn loop 44'. Also, as disclosed in FIG. 7, the looper 50 has been completely withdrawn from the previously formed loop 44 and is commencing its first stroke in the next stitch cycle to engage the next yarn loop 44' carried by the needle 20.

FIGS. 3–7 illustrate one complete stitch cycle in which the needle 20 reciprocates through one stroke, while the looper 50 reciprocates through two strokes for each stroke of the needle 20. The resulting line of chain stitching 74 of the yarn 40 is apparent in FIGS. 2–8.

In the modification disclosed in FIGS. 10 and 11, a looper 150, in the form of a conventional cut pile hook, and pointing in the same direction as the looper 50 utilized in the formation of the chain stitching 74, may be used in cooperation with a conventional cut pile knife 75 in order to form the cut pile stitching 76. Since the looper 150 disclosed in FIGS. 10 and 11 is still driven at twice the reciprocable speed of the needle 20, by the same drive mechanisms which drive the looper 50, such as those disclosed in FIG. 1, then the knife 75 will only cut a loop 145 every other time that it cooperates with the bill 164. The bill 164 seizes a loop 144 on the needle 20 only on the first of the two looper strokes in a stitch cycle. Although FIGS. 10 and 11 disclose only the first reciprocal cutting stroke of the looper 150, the second reciprocal stroke of the looper 150 in the cutpile stitch cycle (not shown) is identical to the first stroke, except no loop is seized by the looper 150, and consequently no loop is cut by the knife 75.

Nevertheless, because of the double stroke of the looper 150 for each single stroke of the needle 20, the amplitude, or distance through which the looper 150 reciprocates, may be much less than the amplitude of its stroke in a conventional cut pile tufting machine. Therefore, the tension angle between the knife 75 and the looper 150, and therefore the pressure exerted by the knife 75 against the looper 50 need not be as great as that for corresponding parts in a conventional cut pile tufting machine. Accordingly, the wear between the looper 150 and the knife 75 is less, thus prolonging the life of the loopers and the knives, even though the looper is reciprocated at twice the rate of the needle.

Referring now to FIGS. 12–23, the double-bladed looper 80 may be substituted for each looper 50 in the looper mechanism 48, and the needle 120 may be substituted for each needle 20 in the needle bar 18.

The looper includes a pair of hook blades 81 and 82.

The hook blade 81 includes a shank 83 and a bill 84 projecting from the shank 83 and having its upper and lower edges converging forward to a pointed end portion 85, which also curves inward slightly.

In a somewhat similar manner, the hook blade 82 includes a shank 87 having a projecting bill 88 with its upper and lower edges converging forward in a pointed end portion 89, which also curves inward.

The lower portions of the shanks 83 and 87 are fixed to the opposite sides of a shank extension member 90 by fastener members 91, so that the shanks 83 and 87 are spaced apart side-by-side, with the bills 84 and 88 projecting generally parallel to each other and pointing in the same direction. The pointed end portions 85 and 89 curve toward each other, so that the pointed portion 89 is very closely adjacent to, if not actually touching, the pointed end portion 85.

The shank extension member 90 is secured in the transverse hook bar 92, along with a plurality of other transversely aligned shank extension members, not shown, in the same manner that the loopers 50 are secured to the hook bar 52. The hook bar 92 is driven in the same manner as the hook bar 52, and with the same timing as the hook bar 52 in relationship to the respective needles 120 and 20, so that each looper 80 will have multiple reciprocal strokes for each stroke of the needle 120 in each stitching cycle.

Each of the bills 84 and 88 intersect the front edge of its respective shank 83 and 87 in a groove 95 and 96 respectively. The grooves 95 and 96 are substantially transversely aligned and adapted to receive the seized loop 44, in the same manner as the groove 71 in the looper 50.

The needle 120 includes an inset flat portion 98 slightly above the eye 99, as do many conventional tufting needles, for guiding the pointed end portion 89 of the hook blade 87 across the needle 120.

In the operation of the invention to form chain-stitching utilizing the modified double-blade looper 80 and the needle 120, the timing of the looper 80 and the needle 120 may be the same as the timing of the looper 50 and needle 20. The sequence of the relative positions of the needle 120 and the looper 80 disclosed in FIGS. 17–21 are substantially identical to the corresponding positions of the needle 20 and looper 50 illustrated in FIGS. 3–7.

Figures 12, 13, 14, 15, 16, 17, 18, 19, 20, 21, 22, 23:
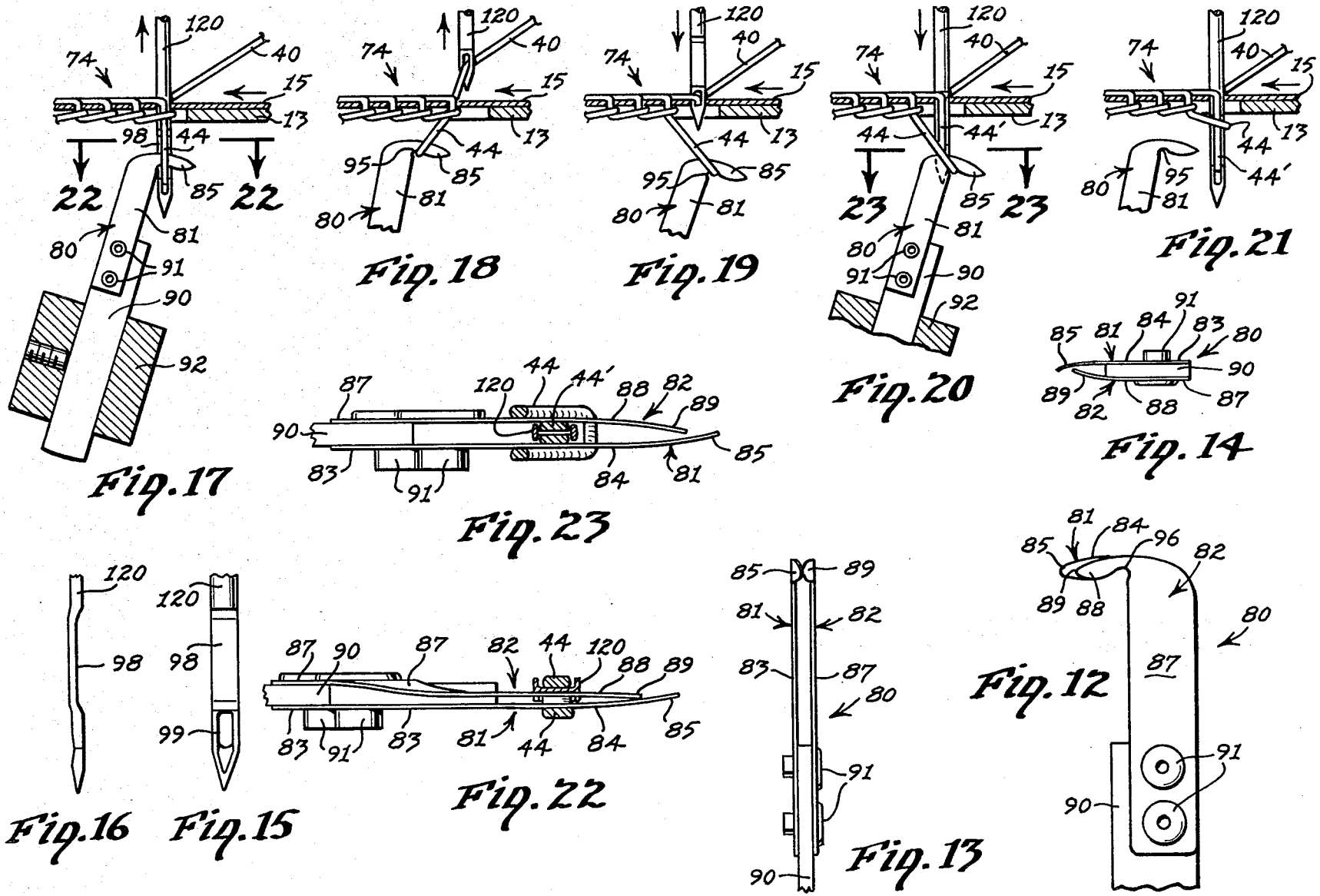
FIG. 12 is an enlarged fragmentary side elevation of a modified, double-bladed looper.
FIG. 13 is a fragmentary front elevation of the looper disclosed in FIG. 12.
FIG. 14 is a fragmentary top plan view of the looper disclosed in FIG. 12.
FIG. 15 is an enlarged fragmentary side elevation of the lower portion of the needle used with the looper disclosed in FIG. 12.
FIG. 16 is a fragmentary rear elevation of the needle disclosed in FIG. 15.
FIG. 17 is a view similar to FIG. 3 incorporating the modified looper illustrated in FIG. 12.
FIG. 18 is a view similar to FIG. 4 incorporating the modififed looper.
FIG. 19 is a view similar to FIG. 5 incorporating the modified looper.
FIG. 20 is a view similar to FIG. 6 incorporating the modified looper.
FIG. 21 is a view similar to FIG. 7 incorporating the modified looper.
FIG. 22 is an enlarged, fragmentary section taken along the line 22—22 of FIG. 17.
FIG. 23 is an enlarged, fragmentary section taken along the line 23—23 of FIG. 20.

As the needle 120 rises from its lowermost position, as illustrated in FIG. 17, the double-bladed looper 80 crosses the path of the needle 120 to seize the loop 44. In this initial portion of the first stroke of the looper 80, both bills 84 and 88 of the hook blades 81 and 82 cross the needle 120 on the same side so that both bills 84 and 88 project between the inset flat portion 98 and one leg of the loop 44, as best illustrated in FIG. 22.

After the loop 44 is seized by both bills 84 and 88, the needle 120 rises, while the looper 80 retracts rearward with the loop 44 caught in the grooves 95 and 96, as illustrated in FIG. 18.

While the needle 120 is still above the base fabric 15, the looper 80 again moves forward in its second stroke of the same stitch cycle, to carry the yarn loop 44 forward across the needle path. In this forward position of the looper 80 (FIG. 19), the loop 44 is stretched around the exterior surfaces of both spaced bills 84 and 88 to provide a large opening in the loop 44 for penetration by the needle 120, as illustrated in FIG. 23. The needle 120 then descends to penetrate the large opening between the legs of the loop 44 and continues to penetrate the space between both hook blades 81 and 82, spreading the blades 81 and 82, if necessary. The hook blades 81 and 82 are preferably made of thinner metal than a single blade looper, such as the looper 50, to permit such limited flexibility, not only for penetration between the blades 81 and 82 by the needle 120, but also for biasing the blade bills 84 and 88 together as they cross the needle 120 on the same side in the first stroke illustrated in FIGS. 17 and 22.

The penetration of the needle 120 through the open loop 44 and the spacing between the hook blades 81 and 82 is best disclosed in FIGS. 20 and 23.

After the needle 120, carrying the yarn 40, penetrates the opening in the yarn loop 44, the looper 80 again retracts toward its rearward position (FIG. 21) to remove the looper bills 84 and 88 from the yarn loop 44 and the needle 120. The downstroke of the needle 120 pulls the yarn 40 down through the base fabric 15 to tighten the release yarn loop 44 about the needle 120 and about the yarn carried by the needle in forming the next yarn loop 44', as illustrated in FIG. 21.

Thus, except for the utilization of two hook blades 81 and 82 and a looper 80, functioning in the above prescribed manner, the operation of the formation of the chain-stitching 74 by the needle 120 and the looper 80 is substantially the same as that described for the operation of the needle 20 and looper 50.

It will be noted that the pointed end portion 89 of the hook blade 82 does not extend as far forward as the pointed end portion 85 of the hook blade 81. The purpose of the shortened structure of the bill 88 is to permit the pointed end portion 85 of the hook blade 81 to overlap or shield the pointed end portion 89 so that the pointed end portion 89 will not engage the leg of the loop 44, to tag the loop yarn, or to cause the leg of the yarn loop 44 to separate the pointed end portions 85 and 89 and pass between the bills 84 and 88 of the hook blades 81 and 82. Thus by having the longer pointed end portions 85 curve toward and slightly in front of the pointed end portion 89, as best illustrated in FIG. 14, both bills 84 and 88 are assured of passing together between the outside leg of the loop 44 and the needle 120.

On the other hand, during the second stroke of the looper 80 in its stitch cycle, to its extreme position (FIG. 20), the needle 120 may easily separate the bills 84 and 88, since the needle 120 passes behind the converged pointed end portions 85 and 89, as illustrated in FIG. 23.

What is claimed is:

1. In a machine forming stitches in a base fabric, including means supporting a base fabric for longitudinal movement in a fabric plane through the machine, a needle bar on one side of the fabric plane, at least one needle mounted on the needle bar and adapted to carry a yarn through the base fabric, needle drive means for reciprocally moving the needle bar toward and away from the fabric plane to move the needle in a needle path through the base fabric in a plurality of reciprocal needle strokes, each needle stroke constituting a stitch cycle, and means supplying yarn to the needle, a looper mechanism comprising:

(a) a looper hook for each needle on the opposite side of the fabric plane from its corresponding needle and pointing in the direction opposite to the direction of the movement of the base fabric, and (b) looper drive means for reciprocally moving said looper hook across and proximate to the corresponding needle path for periodic seizure of a loop of yarn carried by a corresponding needle in a plurality of reciprocal looper strokes, the number of said looper strokes being a multiple of each needle stroke in a stitch cycle.

2. The invention according to claim 1 in which the ratio of the number of looper strokes to the number of needle strokes is 2:1 for each stitch cycle, so that said looper seizes a yarn loop from its corresponding needle on each first looper stroke of said stitch cycle and said needle penetrates and releases said seized loop from said looper on each second looper stroke of said stitch cycle, to form a chain stitch in said base fabric.

3. The invention according to claim 2 in which said needle drive means comprises a rotary needle drive shaft, and said looper drive means comprises a rotary looper drive shaft driven at twice the rotary speed of said needle drive shaft, and means for synchronously driving said needle drive shaft and said looper drive shaft.

4. The invention according to claim 2 in which each looper hook has a bill pointing in the direction opposite the longitudinal direction of movement of the base fabric, said bill having a bottom edge, and a groove in said bottom edge for receiving and retaining a portion of a yarn loop seized on said bill until said seized loop is released by the corresponding needle penetrating said loop.

5. The invention according to claim 1 further comprising a knife adapted to cooperate with said looper to cut a seized yarn loop to form a cut pile loop, and cutter drive means for reciprocally moving said knife at the same cyclical rate as the movement of said looper.

6. The invention according to claim 1 in which each looper hook comprises a pair of transversely spaced hook blades adapted to seize a first yarn loop carried by a corresponding needle during a first looper stroke in a stitch cycle, said needle being adapted to carry a second yarn loop down between said spaced hook blades during a subsequent looper stroke in said stitch cycle.

7. The invention according to claim 6 in which said hook blades have bills projecting substantially side-by-side in one direction opposite to the direction of fabric movement, and terminating in pointed end portions converging toward each other.

8. The invention according to claim 7 in which said hook blades comprise a proximal blade and a remote blade, said proximal blade being closer to said corresponding needle path than said remote blade during said first looper stroke to seize said yarn loop, the pointed end portion of the bill of said remote blade projecting in said one direction slightly beyond the pointed end portion of the bill of said proximal blade, to engage and open the yarn loop carried by said needle, for seizure by said looper hook.

9. The invention according to claim 8 in which said looper drive means causes said proximal blade and said remote blade to move across said needle path on one side of said needle to seize said yarn loop during said first looper stroke, the portion of said hook blades in alignment with said needle path during a subsequent looper stroke being spaced apart sufficiently to permit said needle to carry a second yarn loop down between said spaced hook blades.

10. The invention according to claim 9 in which said proximal blade is flexibly movable upon engagement by the needle toward said remote blade on said first looper stroke and away from said remote blade when engaged by the needle during said subsequent looper stroke.

11. The invention according to claim 2 further comprising a needle bar on one side of the fabric plane, at least one needle mounted on the needle bar and adapted to carry a yarn through the base fabric, needle drive means for reciprocably moving the needle bar toward and away from the fabric plane to continuously move said needle in said needle path through the base fabric in a plurality of continuous reciprocal needle strokes, said looper drive means causing said looper hook to continuously reciprocably move across and proximate to said corresponding needle path.

12. A looper hook for use in cooperation with a needle in a stitching machine, comprising:

(a) a first hook blade having a shank and a first bill projecting from said shank and terminating in a pointed end portion, (b) a second hook blade having a shank and a second bill projecting from said shank and terminating in a pointed end portion, (c) means fixing said shanks side-by-side with said bills substantially parallel and pointing in the same direction, the pointed end portion of said first bill projecting farther in said same direction than the pointed end portion of said second bill, (d) said pointed end portions converging proximate to each other, (e) said second bill being flexible to permit movement of said second bill toward and away from said first bill, (f) said hook blades being spaced apart to permit the passage of a needle between said hook blades behind said converging pointed end portions (g) each of said bills having a bottom edge, and (h) a groove in each of said bottom edges, said grooves being transversely aligned for receiving and retaining a portion of a yarn loop seized on said hook blades.

13. The invention according to claim 12 further comprising a needle and means for driving said needle in a reciprocable needle path, and a looper drive means for reciprocably moving said looper hook in a reciprocable path across said needle path between a retracted position out of said needle path and a forward protracted position in which said grooves are in front of said needle path as said needle descends between said blades behind said grooves, to penetrate a loop of yarn held in said grooves and spread by said blades.

* * * * *